US006023214A

United States Patent [19]

Ohta et al.

[11] Patent Number: 6,023,214

[45] Date of Patent: Feb. 8, 2000

[54] SHEET TRANSFORMER

[75] Inventors: Satoshi Ohta; Fumiaki Nakao; Tetsuya Suzuki; Mikio Kitaoka, all of Minato-ku, Japan

[73] Assignee: FDK Corporation, Tokyo, Japan

[21] Appl. No.: 09/158,107

[22] Filed: Sep. 22, 1998

[30] Foreign Application Priority Data

Mar. 18, 1998 [JP] Japan ..... 10-068734

[51] Int. Cl.[7] ..... H01F 5/00; H01F 27/36

[52] U.S. Cl. ..... 336/84 R; 336/200; 336/223; 336/232

[58] Field of Search ..... 336/200, 84 R, 336/223, 232

[56] References Cited

U.S. PATENT DOCUMENTS 3,963,975 6/1976 Gauper, Jr. et al. ..... 336/84
4,041,364 8/1977 Gauper, Jr. ..... 363/15
5,122,947 6/1992 Hishiki ..... 336/61
5,521,573 5/1996 Inoh ..... 336/180

*Primary Examiner*—Michael L. Gellner
*Assistant Examiner*—Anh Mai
*Attorney, Agent, or Firm*—Wenderoth, Lind & Ponack, L.L.P.

[57] ABSTRACT

A sheet transformer wherein a coil pattern is formed on each of substrates so as to constitute a coil substrate, a plurality of the coil substrates are overlaid in multiple layers to form a primary coil and a secondary coil. The primary coil and the secondary coil are overlaid such that the middle leg cores of EE type, EI type, EER type or EIR type cores are disposed in the center of the coils and both the outside leg cores are disposed outside the coils, thereby obtaining a magnetic coupling between the coils. A higher potential side of the primary coil and a higher potential side of the secondary coil are disposed in an opposed configuration so as to face each other.

6 Claims, 10 Drawing Sheets

SHEET TRANSFORMER

BACKGROUND OF THE INVENTION

1. Field of the Invention

The present invention relates to a sheet transformer suitable for a thin sheet type power supply transformer for use in, for example, telephone exchanges, industrial inverters, thin type displays and the like.

2. Description of the Related Art

Generally, a transformer having a structure as shown in FIG. 15 is well known. In this transformer, conductive wires are wound around parallel portions of a rectangular core 1 so as to form a primary coil 2 and a secondary coil 3. A power supply 4 is connected to both terminals of the primary coil 2 through a switch terminal 5 such as a MOS-FET, or the like. Further, one terminal of the secondary coil 3 is grounded and a load 6 is connected to the other terminal through a stabilizing circuit. A voltage applied to the primary coil 2 is converted to a predetermined voltage by dielectric action between the primary coil 2 and secondary coil 3 and applied to the load 6. This type of transformer is called a fly-back transformer.

In such a transformer, a problem occurs when the voltage applied to the primary coil 2 induces a voltage in the secondary coil 3. A voltage difference in time change occurs between the primary coil 2 and the secondary coil 3 (i.e., a voltage difference between the primary coil 2 and the secondary coil 3 according to the change of time) resulting in the generation of noise.

SUMMARY OF THE INVENTION

Accordingly, the present invention has been proposed to solve the above problem, and it is therefore an object of the invention to provide a sheet transformer capable of suppressing the occurrence of noise during its operation.

According to a first aspect of the present invention, a sheet transformer is provided wherein a coil patter is formed on each substrate so as to constitute a coil substrate, and a plurality of coil substrate are overlaid in multiple layers forming a primary coil and a secondary coil. The primary coil and secondary coil are overlaid such that middle leg core portions of the EE type, IE type, EER type or EIR type cores, which all have an E-shaped core, are disposed in the center of the coils with both outside leg core portions thereof disposed outside of the coils, thereby obtaining magnetic coupling between the coils, wherein a higher potential side of the primary coil and an opposite side to a coil end connected in series to a secondary rectifying element of the secondary coil are disposed in an opposed configuration with each other.

According to a second aspect of the present invention, there is provided a sheet transformer comprising a plurality of coil substrates each having substrates and coil patterns formed on the substrate. A coil means has a primary coil and a secondary coil, the secondary coil having a first coil end and a second coil end opposite to the first coil end. The primary coil and the secondary coil are overlaid in multiple layers. A magnetic coil has two outer legs and a middle leg between the outer legs, the middle leg of the magnetic core being disposed outside the coil means and the outer legs of the magnetic core being disposed outside the coil means so that a magnetic coupling is produced between the coil means. A rectifying element is connected in series with the second coil end of the secondary coil, wherein a higher potential side of the primary coil is positioned in a confronting configuration with the first coil end opposite to the second coil end connected in series to the rectifying element.

According to a third aspect of the present invention, a sheet transformer is provided according to the second aspect described above, wherein the secondary coil is disposed between a first turn and a second turn of the higher potential side of the primary coil such that the opposite side to the coil end connected in series to the secondary rectifying element of the secondary coil faces, or is in an opposed configuration with, the first turn of the primary coil.

According to a fourth aspect of the present invention, a sheet transformer is provided according to the second aspect wherein the primary coil is divided into two parallel sets and the secondary coil is disposed between the divided sets of the primary coil such that a higher potential side of one divided set of the primary coil is disposed to face the opposite side of the coil end connected in series with the secondary rectifying element of the secondary coil.

According to a fifth aspect of the present invention, a sheet transformer is provided wherein a coil pattern is formed on each substrate so as to constitute a coil substrate, a plurality of the coil substrates are overlaid in multiple layers so as to form a primary coil and a secondary coil, and the primary coil and the secondary coil are overlaid such that middle leg core portions of the EE type, EI type, EER type or EIR type cores are disposed in the center of the coils with both outside leg cores thereof disposed outside the coils. This creates a magnetic coupling between the coils, wherein a shield is connected to a higher potential side of the primary coil or an opposite side of a coil end connected in series to a secondary rectifying element of the secondary coil such that the shield faces the opposite side with the coil end connected in series to the secondary rectifying element of the secondary coil or the higher potential side of the primary coil.

According to a sixth aspect of the present invention, there is provided a sheet transformer according to the fifth aspect wherein shields are connected to the higher potential side of the primary coil and the opposite side with the coil end connected in series with the secondary rectifying element of the secondary coil such that the shields face each other between the primary coil and the secondary coil.

DESCRIPTION OF THE PREFERRED EMBODIMENTS

First Embodiment

Figure 1:
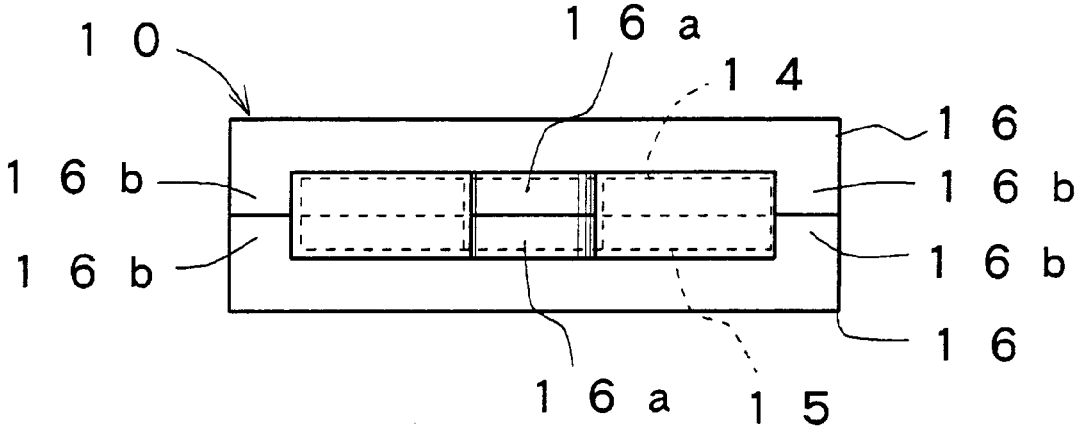
FIG. 1 is a front view of a sheet transformer according to a first embodiment of the present invention.

Hereinafter, a first embodiment of the present invention will be described with reference to the accompanying drawings. FIGS. 1–4 show a sheet transformer according to the present embodiment and reference numeral 10 denotes the sheet transformer.

Figure 2:
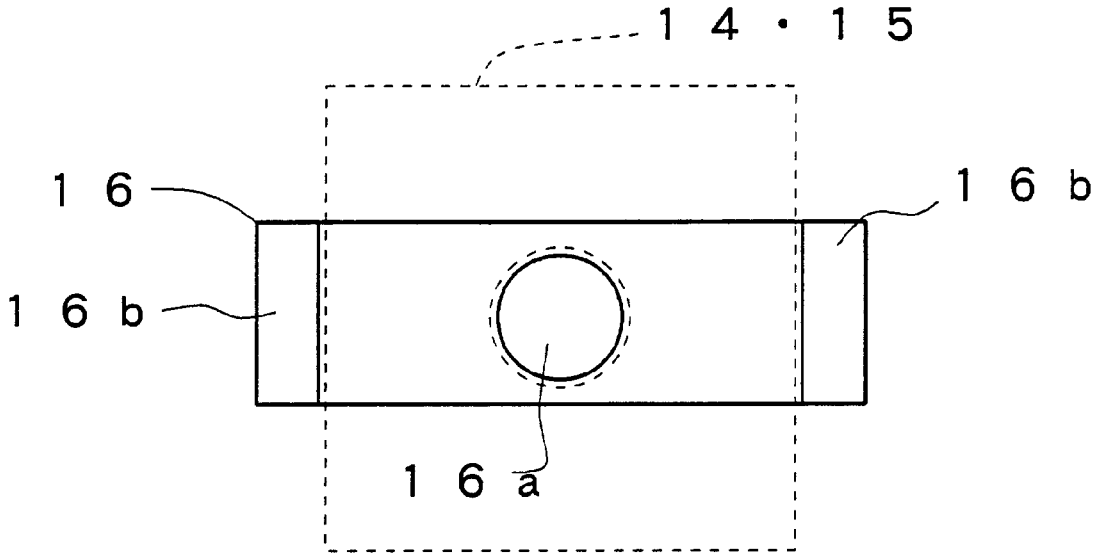
FIG. 2 is a partial plan view of the sheet transformer shown in the first embodiment of the present invention.
Figure 3:
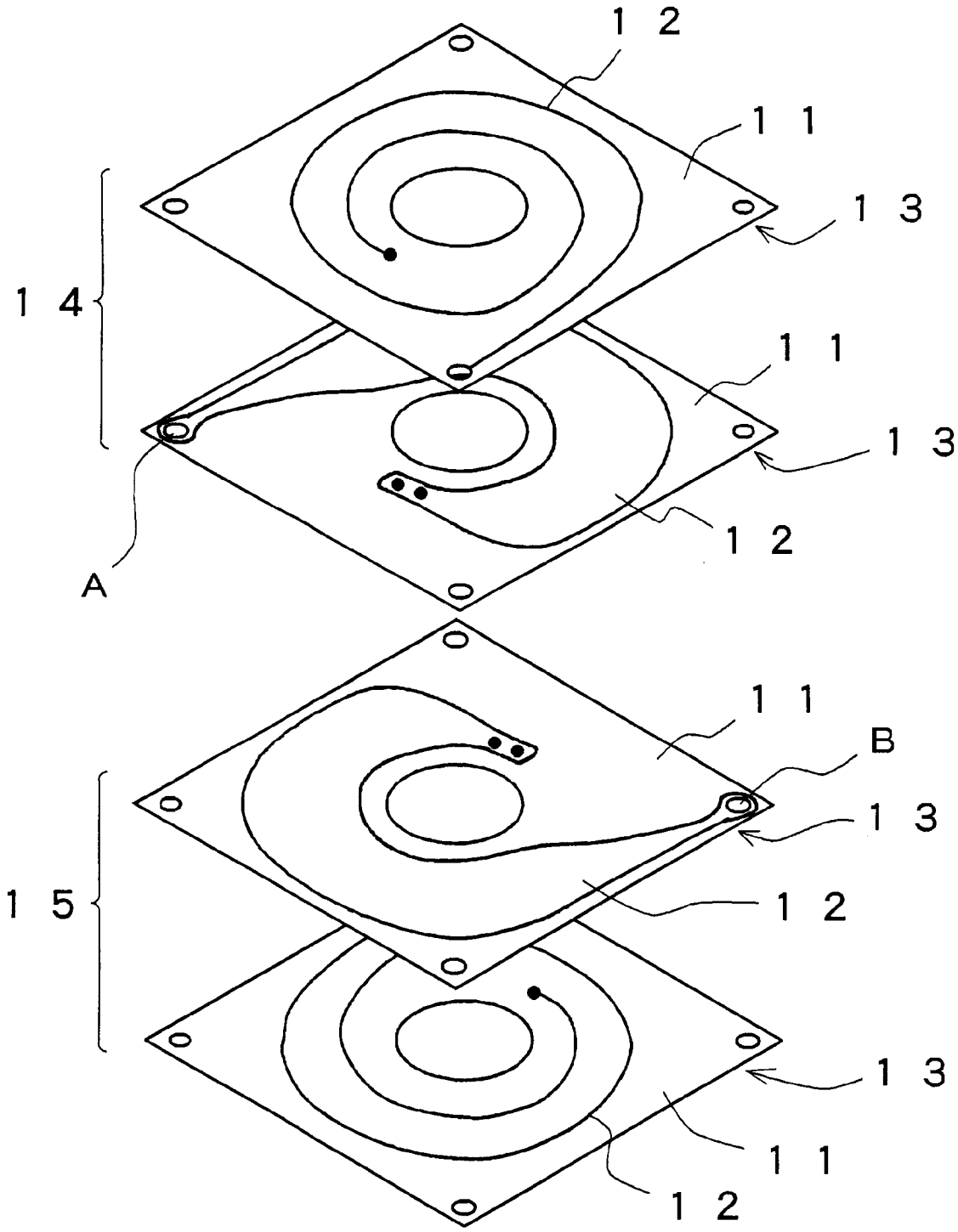
FIG. 3 is a fragmentary perspective view of coils according to the first embodiment of the sheet transformer of the present invention.

The sheet transformer 10 is formed as follows. As shown in FIG. 3, a coil pattern 12 is formed on a substrate 11 so as to constitute a coil substrate 13. A plurality of coil substrates 13 are overlaid in multiple layers so as to form a primary coil 14 and a secondary coil 15. As shown in FIGS. 1 and 2, the primary coil 14 and secondary coil 15 are overlaid and middle leg cores 16*a* of a pair of EE type cores 16 are disposed in the center of the coils 14 and 15 and both outside leg cores 16*b* of the EE type cores 16 are disposed outside the coils 14 and 15 so that a magnetic coupling is obtained between the coils 14 and 15.

Figure 4:
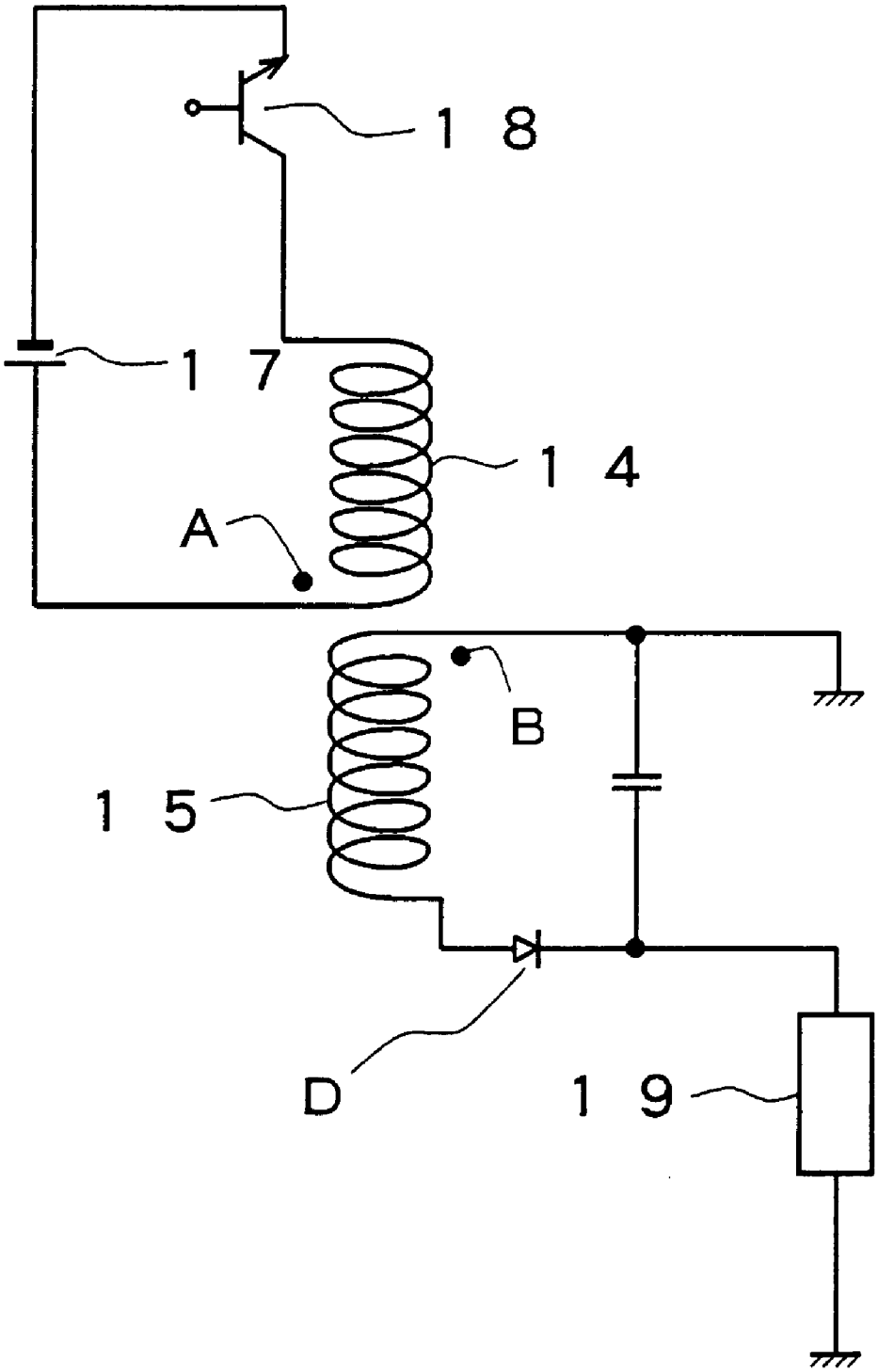
FIG. 4 is a circuit diagram in which the first embodiment of the sheet transformer of the present invention is applied.

According to the first embodiment, as shown in FIG. 4, a power supply 17 and a switch element 18 are connected between both terminals of the primary coil 14. One terminal of the secondary coil 15 is grounded and the other terminal is connected to a load 19 through a stabilizing circuit. In the primary coil 14, a coil end A connected to a positive end of the power supply 17 has a higher potential . In the secondary coil 15, a coil end B, which is an opposite side of a coil end connected in series to a secondary rectifying element D, has a higher potential.

Thus, in the present embodiment, the coil end A of the higher potential side of the primary coil 14 and the coil end B of the higher potential side of the secondary coil 15 are overlaid in an opposed (confronting) configuration with an insulation layer (not shown) as separation, so as to be facing each other and to be mounted between both the EE type cores 16. More specifically, the pattern surface of the coil end A and the pattern surface of the coil end B are overlaid upon each other with an insulating layer (not shown) separating them.

As a result of carrying out an operation verification test on the sheet transformer having such a structure, little noise was recognized and a high quality operation characteristic was obtained. The noise is suppressed in the sheet transformer 10 according to the present embodiment because a potential (voltage) between the coil end A of the higher potential side of the primary coil 14 and the coil end B of the higher potential side of the secondary coil 15 is stabilized. By disposing these portions (sides) in an opposed or overlaid configuration, a change in the time series of the voltage difference (i.e., a voltage difference according to a time change) between the primary coil 14 and the secondary coil 15 can be suppressed to a minimum level.

Second Embodiment

Figure 5:
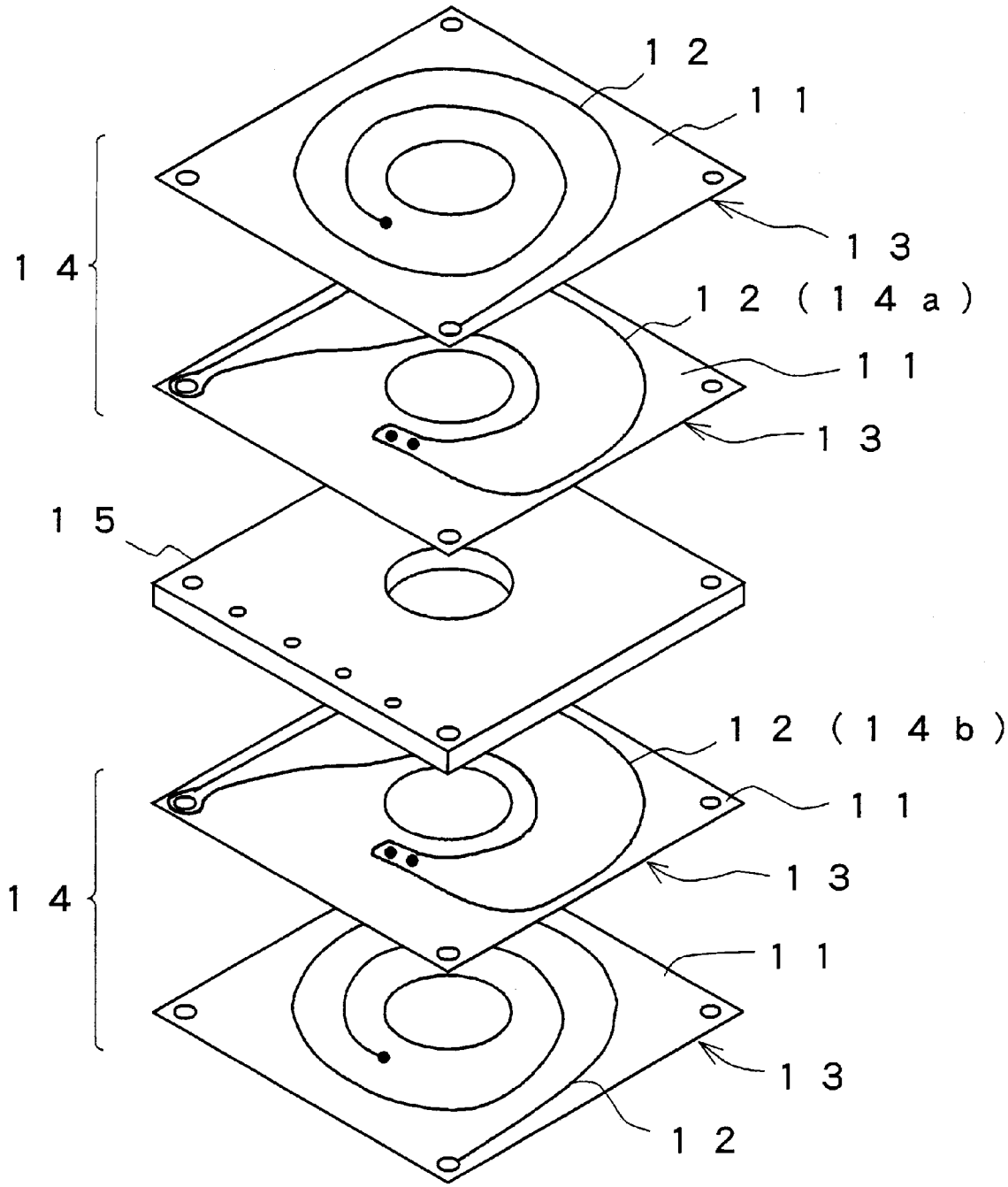
FIG. 5 is a fragmentary perspective view of coils according to a second embodiment of the present invention.
Figure 6:
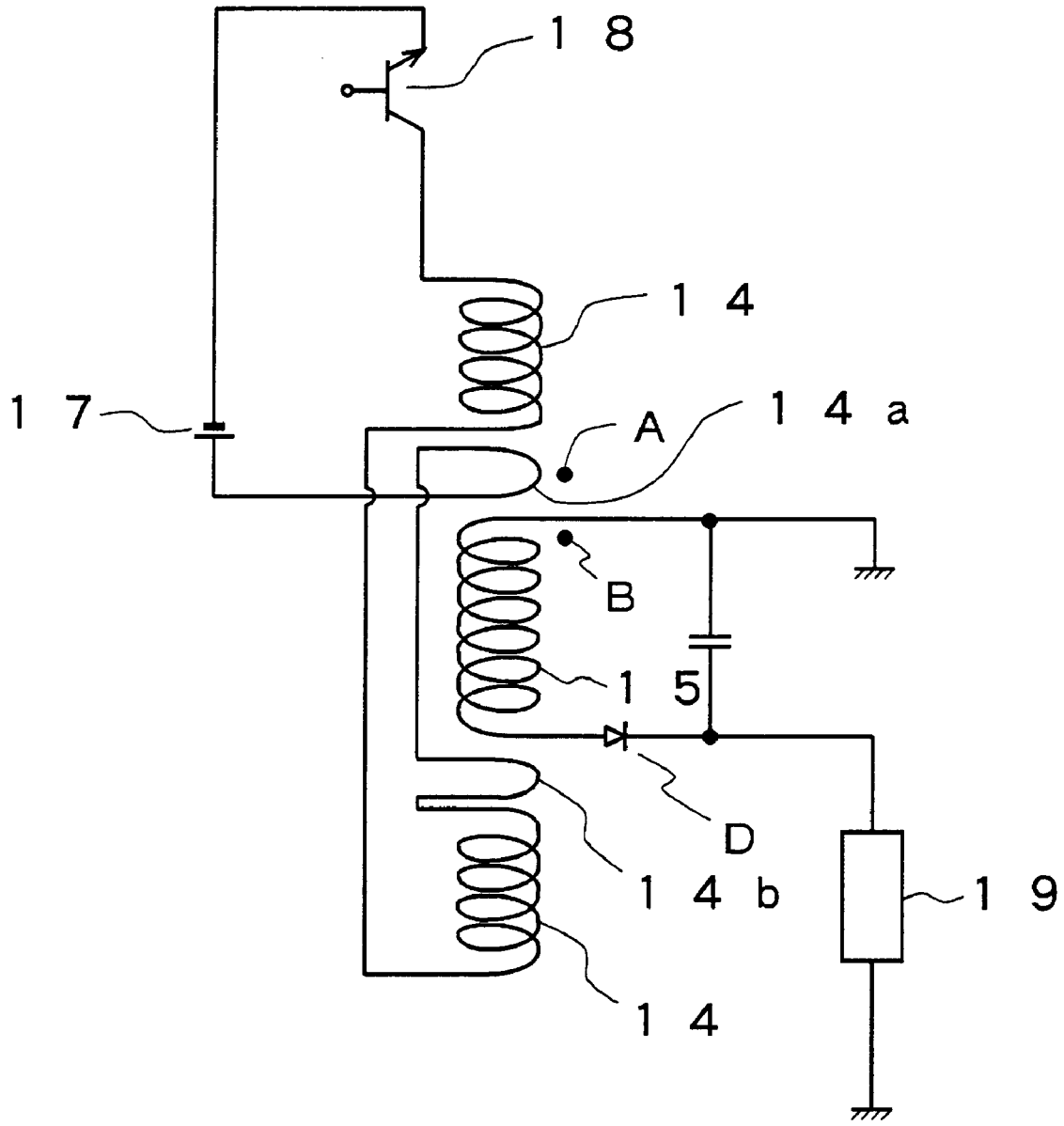
FIG. 6 is a circuit diagram in which the second embodiment of the sheet transformer of the present invention is applied.

Next, a second embodiment of the present invention will be described with reference to FIGS. 5 and 6. In the second embodiment, a secondary coil 15 is disposed between a first turn 14*a* and a second turn 14*b* of the coil end A of the higher potential side of the primary coil 14 and, as shown in FIG. 6, the coil end B of the higher potential side of the secondary coil 15 is disposed to face the first turn 14*a* of the primary coil 14.

According to this structure, which is similar to the first embodiment, the portions (sides) having a stabilized potential are disposed and overlaid in an opposed configuration and, accordingly, a change in the time series of the voltage difference (i.e., a voltage difference by the change of time) induced between the coils 14 and 15 is suppressed. Further, the secondary coil 15 is sandwiched between the portions (sides) of the primary coils having a stabilized potential, so that the change in the time series of the voltage difference is suppressed to a minimum level, thereby preventing an occurrence of noise.

Third Embodiment

Figure 7:
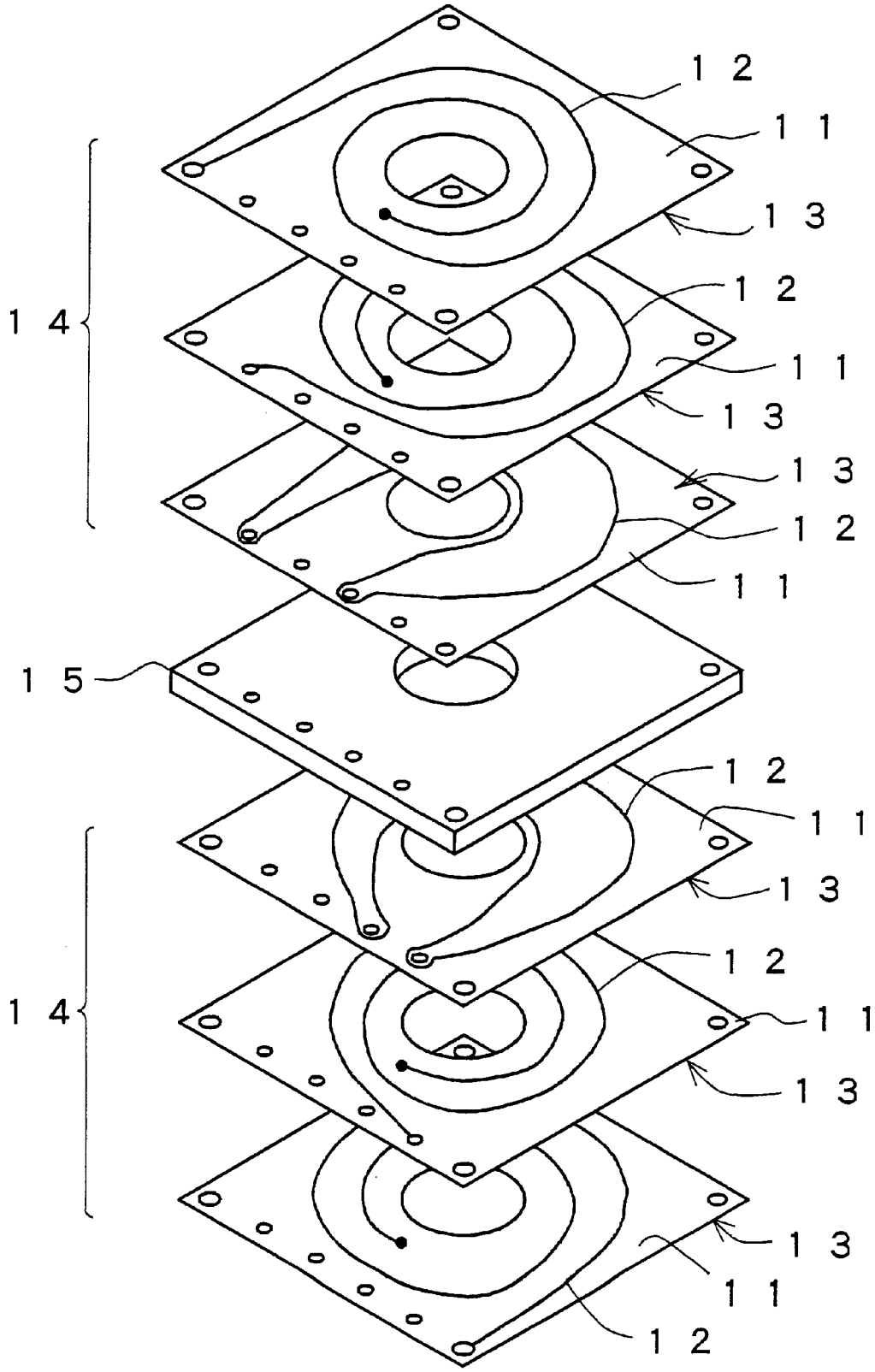
FIG. 7 is a fragmentary perspective view of coils according to a third embodiment of the sheet transformer of the present invention.
Figure 8:
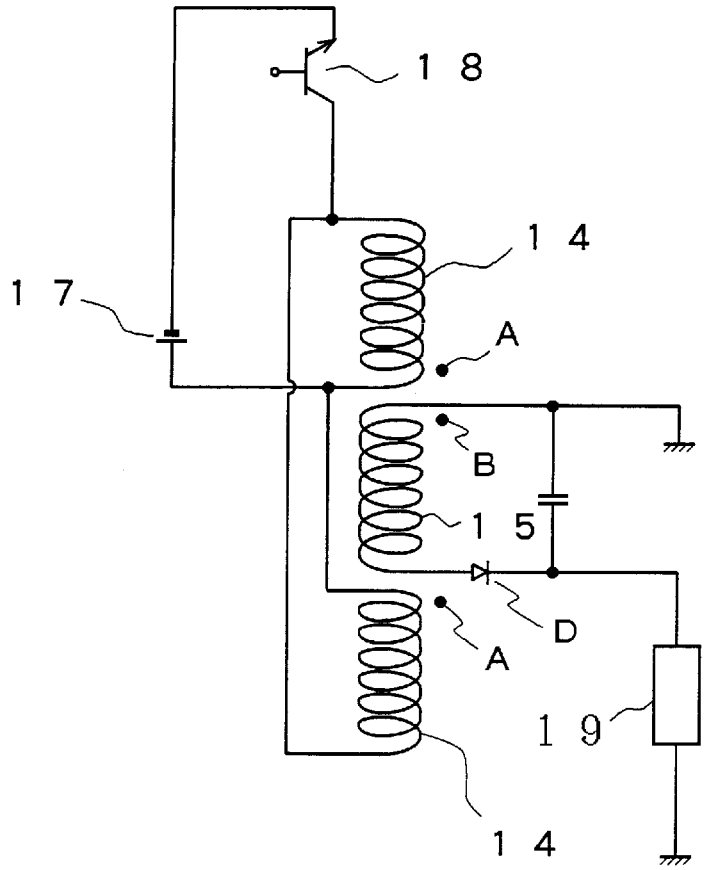
FIG. 8 is a circuit diagram in which the third embodiment of the sheet transformer of the present invention is applied.

Next, a third embodiment of present invention will be described with references to FIGS. 7 and 8. In the third embodiment, the primary coil 14 is divided into two parallel sets and the secondary coil 15 is disposed between the divided sets of the primary coils 14. The coil end A of the higher potential side in the primary coil 14 which is divided into two sets is disposed in an opposed or confronting configuration with the coil end B of the higher potential side of the secondary coil 15.

According to this structure, which is similar to the first embodiment, the portions (sides) having a stabilized potential are disposed to face each other, or to be in a confronting configuration. As a result, a change in the time series of the voltage difference (i.e., a voltage difference by the change of time) induced between the coils 14 and 15 is suppressed. Further, the secondary coil 15 is sandwiched by the portions (sides) of the primary coils 14 having a stabilized potential, so that the change in the time series of the voltage difference is suppressed, thereby preventing an occurrence of noise. Further, since the two divided primary coils 14 are connected in parallel, the DC resistance of the primary coil 14 is decreased, and consequently the energy loss is reduced.

Fourth Embodiment

Next, a fourth embodiment of the present invention will be described with reference to FIGS. 9–12. In the fourth embodiment, a shield 20 is connected to either the higher potential side of the primary coil 14 or the coil end B of the higher potential side of the secondary coil 15. As a result, the shield 20 is disposed to face the coil end B of the higher potential side of the secondary coil 15 or the coil end A of the higher potential side of the primary coil 14.

Figure 9:
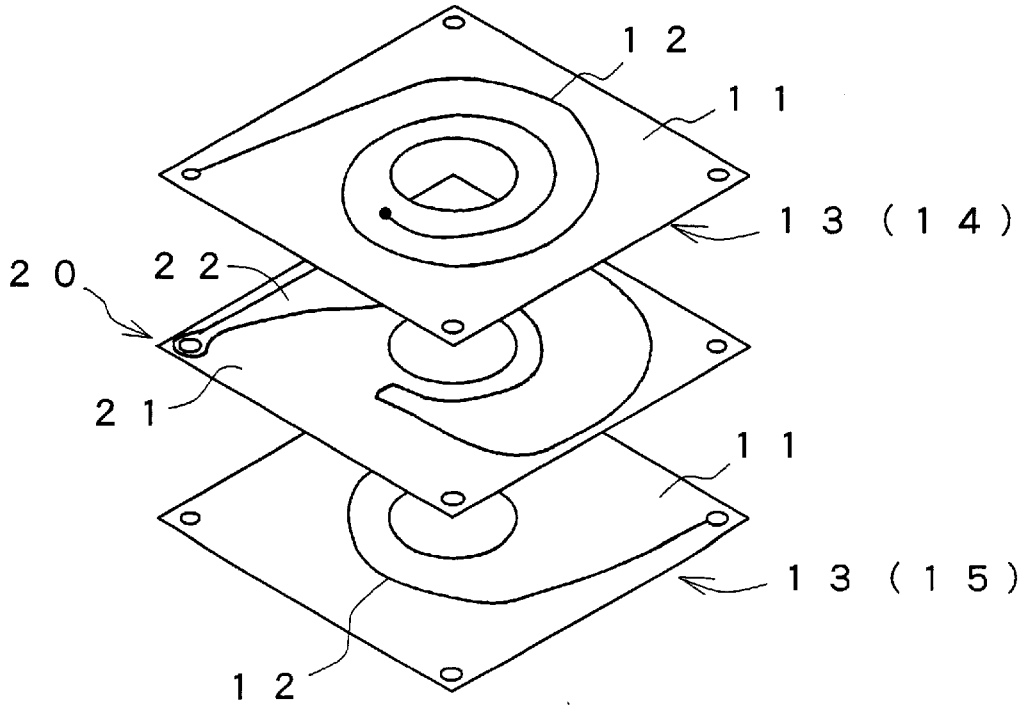
FIG. 9 is a fragmentary perspective view of coils according to a fourth embodiment of the sheet transformer of the present invention.
Figure 10:
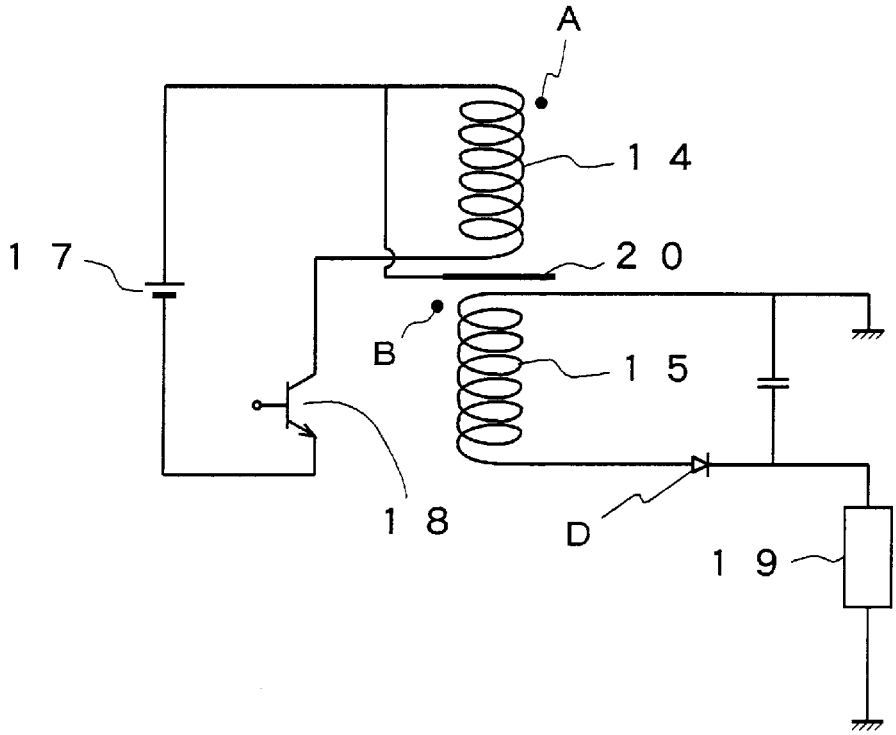
FIG. 10 is a circuit in which the fourth embodiment of the sheet transformer of the present invention is applied.
Figure 11:
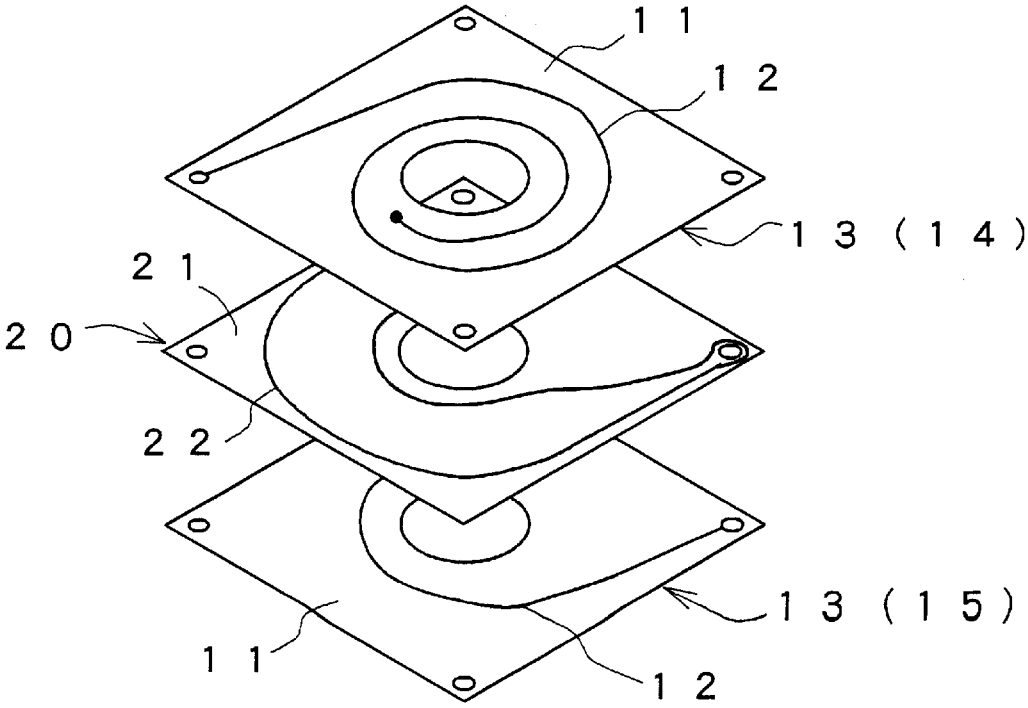
FIG. 11 is a fragmentary perspective view of coils showing a modification of the fourth embodiment of the sheet transformer of the present invention.
Figure 12:
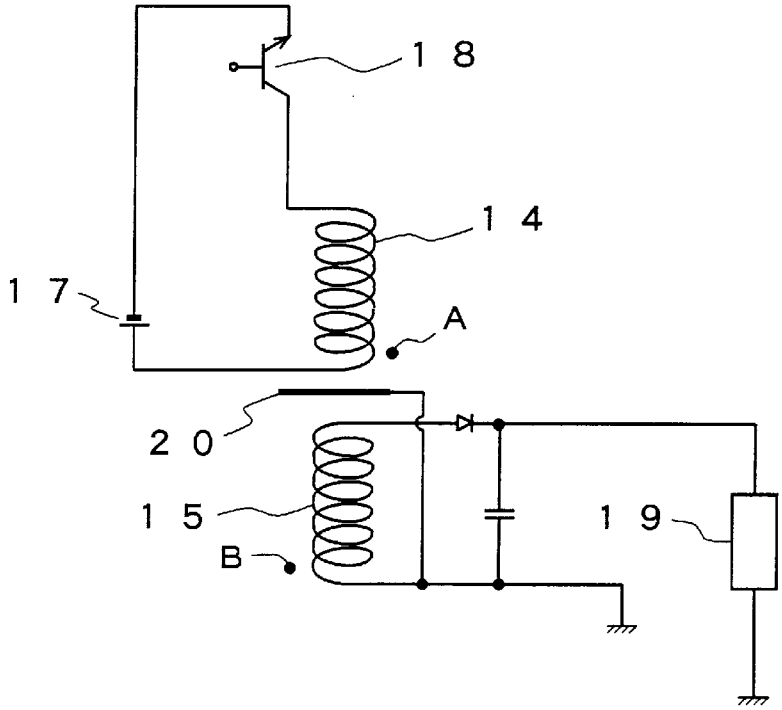
FIG. 12 is a circuit diagram of FIG. 11.

In the shield 20, a shield pattern 22 is formed is formed on a substrate 21. FIGS. 9 and 10 show a structure in which the shield 20 is disposed to face the coil end B of the higher potential side of the secondary coil 15 and connected to the higher potential side of the primary coil 14. Further, FIGS. 11 and 12 show a structure in which the shield 20 is disposed to face the coil end A of the higher potential side of the primary coil 14 and connected in series to the opposite side to the coil end connected in series to the secondary rectifying element D of the secondary coil 15.

Also in such structures, the higher potential side of the primary coil 14 and the coil end B of the higher potential side of the secondary coil 15 are disposed to face each other. As a result, which is similar to the above described respective embodiments, a change in the time series of the potential difference (i.e., a voltage difference by the change of time) between the first coil 14 and the second coil 15 is suppressed, so as to reduce noise to a minimum level. Further, even in the case where it is impossible to dispose the coil end A of the higher potential side of the primary coil 14 and the coil end B of the higher potential side of the secondary coil 15 to directly face each other, the shield 20 can create the noise suppression effect.

Figure 13:
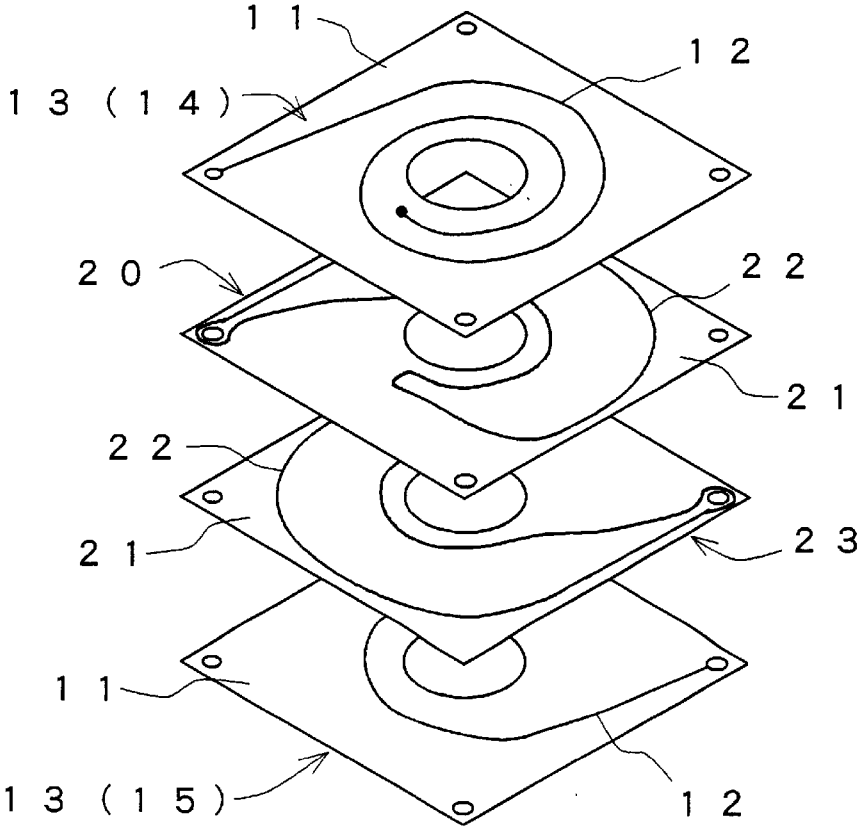
FIG. 13 is a fragmentary perspective view of coils according to the modification of the fourth embodiment of the sheet transformer of the present invention.
Figure 14:
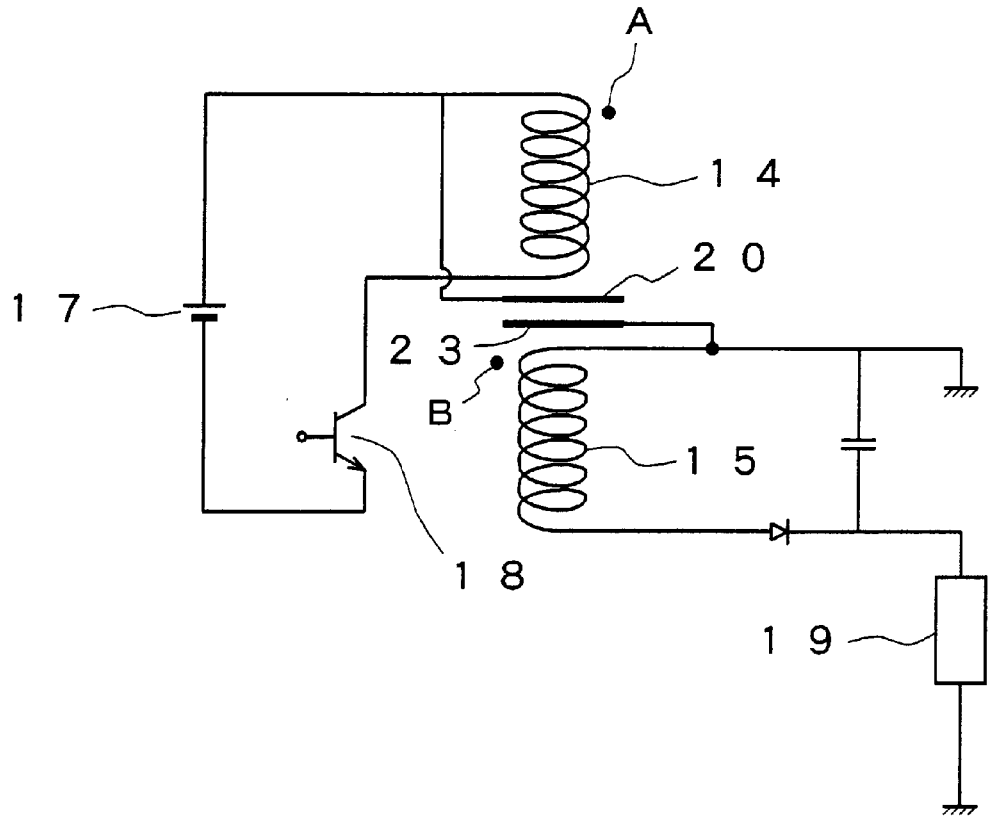
FIG. 14 is a circuit diagram of FIG. 13.
Figure 15:
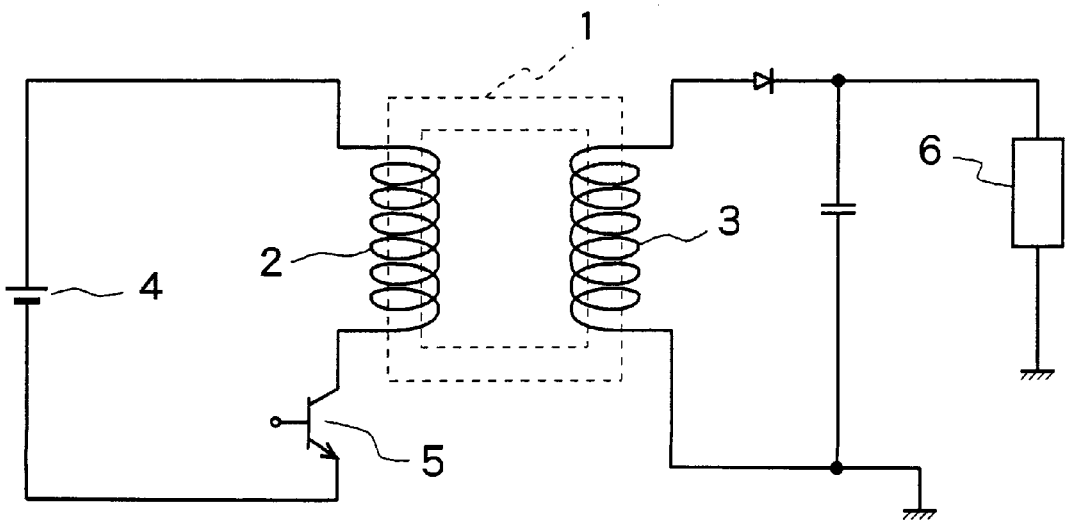
FIG. 15 is a circuit diagram showing a structure of a conventional transformer.

In another embodiment, as shown in FIG. 13 and 14, shields 20 and 23 are connected respectively to the higher potential side of the primary coil 14 and to the higher potential side of the secondary coil 15, so that the shields 20 and 23 face each other between the coils 14 and 15. As a result, the noise reduction effect can be obtained.

According to the present invention, since the higher potential side of the primary coil 14 and the coil end B of the higher potential side of the secondary coil 15 are disposed in an opposed (confronting) configuration with each other and, consequently, a change in the time series of the potential difference (i.e., a voltage difference by the changes in time) between the first coil 14 and the second coil 15 is suppressed so as to reduce noise to a minimum level. As a result, a desired sheet transformer of a high quality can be obtained.

What is claimed is:

1. A sheet transformer comprising:

a plurality of single-turn coil substrates each of which comprises a single-turn coil pattern formed on a substrate;

a plurality of multiple-turn coil substrates each of which comprises a multiple-turn coil pattern formed on a substrate;

a primary coil formed by overlaying at least one of said plurality of single-turn coil substrates and at least one of said plurality of multiple-turn coil substrates, said primary coil having a higher potential side and a lower potential side;

a secondary coil formed by overlaying at least one of said plurality of single-turn coil substrates and at least one of said plurality of multiple-turn coil substrates, said secondary coil having opposite first and second coil ends;

said primary coil and said secondary coil being overlaid, wherein said at least one of said plurality of single-turn coil substrates of said primary coil is positioned closer to said secondary coil than said at least one of said plurality of multiple-turn coil substrates of said primary coil and said at least one of said plurality of single-turn coil substrates of said secondary coil is positioned closer to said primary coil than said at least one of said plurality of multiple-turn coil substrates of said secondary coil;

said at least one of said plurality of single-turn coil substrates of said primary coil being located at said higher potential side of said primary coil;

a core structure comprising a middle leg core portion disposed in a center of said primary coil and said secondary coil and an outside leg core portion disposed outside said primary coil and said secondary coil, thereby obtaining a magnetic coupling between said primary coil and said secondary coil; and a secondary rectifying element electrically connected to said first coil end of said secondary coil;

said higher potential side of said primary coil positioned in an opposed configuration with said second coil end of said secondary coil.

2. A sheet transformer according to claim 1, wherein said secondary coil is disposed between a first turn and a second turn of said higher potential side of said primary coil such that said second coil end of said secondary coil faces said first turn of said primary coil and said first turn and said second turn of said primary coil comprise said at least one of said plurality of single-turn coil substrates.

3. A sheet transformer according to claim 1, wherein said primary coil is divided into two parallel primary coils and said secondary coil is disposed between said parallel primary coils such that a higher potential side of one of said parallel primary coils is disposed so as to face said second coil end of said secondary coil.

4. A sheet transformer according to claim 1, wherein said core structure is an E-shaped core of one of EE type, EI type, EER type and EIR type.

5. A sheet transformer according to claim 1, further comprising a shield connected to either said higher potential side of said primary coil or said second coil end of said secondary coil such that said shield faces said second coil end of said secondary coil or said higher potential side of said primary coil, respectively.

6. A sheet transformer according to claim 1, further comprising shields connected to both said higher potential side of said primary coil and said second coil end of said secondary coil such that said shields face each other between said primary coil and said secondary coil.

* * * * *